US011463805B1

(12) United States Patent
Cheng et al.

(10) Patent No.: US 11,463,805 B1
(45) Date of Patent: Oct. 4, 2022

(54) SPEAKER

(71) Applicants: Inventec (Pudong) Technology Corporation, Shanghai (CN); INVENTEC CORPORATION, Taipei (TW)

(72) Inventors: Yin-Chang Cheng, Taipei (TW); Mu-Heng Tsai, Taipei (TW); Chia-Chen Chen, Taipei (TW); Chi-Zen Peng, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 17/338,693

(22) Filed: Jun. 4, 2021

(30) Foreign Application Priority Data

May 19, 2021 (CN) ..... 202110545718.9

(51) Int. Cl.
*H04R 1/28* (2006.01)
*H04R 1/02* (2006.01)

(52) U.S. Cl.
CPC ..... *H04R 1/2888* (2013.01); *H04R 1/025* (2013.01); *H04R 2201/029* (2013.01); *H04R 2400/11* (2013.01); *H04R 2499/11* (2013.01)

(58) Field of Classification Search
CPC ..... H04R 1/2888; H04R 2201/029; H04R 2400/11; H04R 2499/11; H40R 1/025
USPC ..... 381/332
See application file for complete search history.

(56) References Cited

U.S. PATENT DOCUMENTS

| | | | | |
|---|---|---|---|---|
| 4,516,428 | A * | 5/1985 | Konomi | H04R 19/04 381/151 |
| 9,408,009 | B1 * | 8/2016 | Witte | H04R 31/00 |
| 2008/0219468 | A1 * | 9/2008 | Williams | H04R 1/1091 381/77 |
| 2011/0007929 | A1 * | 1/2011 | Rabu | H04R 1/1033 381/380 |
| 2011/0261989 | A1 * | 10/2011 | Xiao | H04R 1/025 381/387 |
| 2017/0366889 | A1 * | 12/2017 | Schipper | H04R 1/086 |

* cited by examiner

*Primary Examiner* — Sean H Nguyen
(74) *Attorney, Agent, or Firm* — CKC & Partners Co., LLC

(57) ABSTRACT

A speaker includes a rubber cabinet, a driver, and a metal connection ring. The rubber cabinet is fixed to a case of an electronic device. The rubber cabinet accommodates the driver, and the metal connection ring is connected between the rubber cabinet and the driver. Moreover, the metal connection ring surrounds the driver, and the rubber cabinet surrounds the metal connection ring.

11 Claims, 7 Drawing Sheets

SPEAKER

CROSS-REFERENCE TO RELATED APPLICATION

This application claims priority to China Application Serial Number 202110545718.9, filed May 19, 2021, which is herein incorporated by reference in its entirety.

BACKGROUND

Field of Invention

The present invention is related to a speaker.

Description of Related Art

Speakers are a very common device used to output sound. The function of the speaker is to convert electrical signals into mechanical vibration, thereby causing the surrounding air to change density and produce sound.

In the case of a large speaker, a bass enhancement device, such as a bass reflex and a passive radiator, is generally disposed in the speaker, so as to utilize the phase reversal to change the sound pressure of the low frequency band. Therefore, the bass of the speaker can be efficiently improved.

Together with the development of thin and light speakers in recent times, many kinds of speakers, such as those used in smart phones, tablets, and laptops, have become miniaturized to reduce the occupied volume thereof, in view of the small internal space in such devices. However, if the size of speakers becomes small, the performance thereof will be negatively affected.

Therefore, private companies and academic institutions have invested a considerable amount of money, resources, and time to research speakers, so as to improve the various characteristics thereof.

SUMMARY

The present disclosure provides a speaker which includes a rubber cabinet, a driver, and a metal connection ring. The rubber cabinet is fixed to a case of an electronic device. The rubber cabinet accommodates the driver, and the metal connection ring is connected between the rubber cabinet and the driver. Moreover, the metal connection ring surrounds the driver, and the rubber cabinet surrounds the metal connection ring.

In one or more embodiments of the present disclosure, the metal connection ring includes a plurality of extension arms spaced apart along an outer periphery of the metal connection ring.

In one or more embodiments of the present disclosure, the extension arms are T-shaped.

In one or more embodiments of the present disclosure, each extension arm has a first portion and a second portion. A width of the second portion is smaller than a width of the first portion, and the first portion is farther from a center of the metal connection ring than the second portion.

In one or more embodiments of the present disclosure, the rubber cabinet has a bending bottom, and a first portion of the bending bottom is fixed to the case and extends outward from the rubber cabinet.

In one or more embodiments of the present disclosure, the speaker of further includes a double-sided adhesive tape which fixes the bending bottom to the case.

In one or more embodiments of the present disclosure, the rubber cabinet has a bending bottom, and a second portion of the bending bottom is fixed to the case and extends inward from the rubber cabinet.

In one or more embodiments of the present disclosure, the rubber cabinet has a bending bottom, a first portion of the bending bottom is fixed to the case and extends outward from the rubber cabinet, and a second portion of the bending bottom is fixed to the case and extends inward from the rubber cabinet.

In one or more embodiments of the present disclosure, the speaker further includes a double-sided adhesive tape which fixes the bending bottom to the case.

In one or more embodiments of the present disclosure, the rubber cabinet includes a ring-shaped protrusion portion, the metal connection ring includes a ring-shaped recess, and the protrusion portion is received in the recess.

In one or more embodiments of the present disclosure, the metal connection ring includes a step-shaped interior edge configured for fixing the driver.

In embodiments of the present disclosure, a speaker with a rubber cabinet is provided, and the rubber cabinet is made of soft material, so as to decrease the needed space thereof. At the same time, the rubber cabinet can occupy a greater space under the same accommodating space, and the rubber cabinet can also absorb sound waves which are generated by a driver of the speaker, thereby preventing the sound waves from resonating with elements of the speaker and producing noise.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
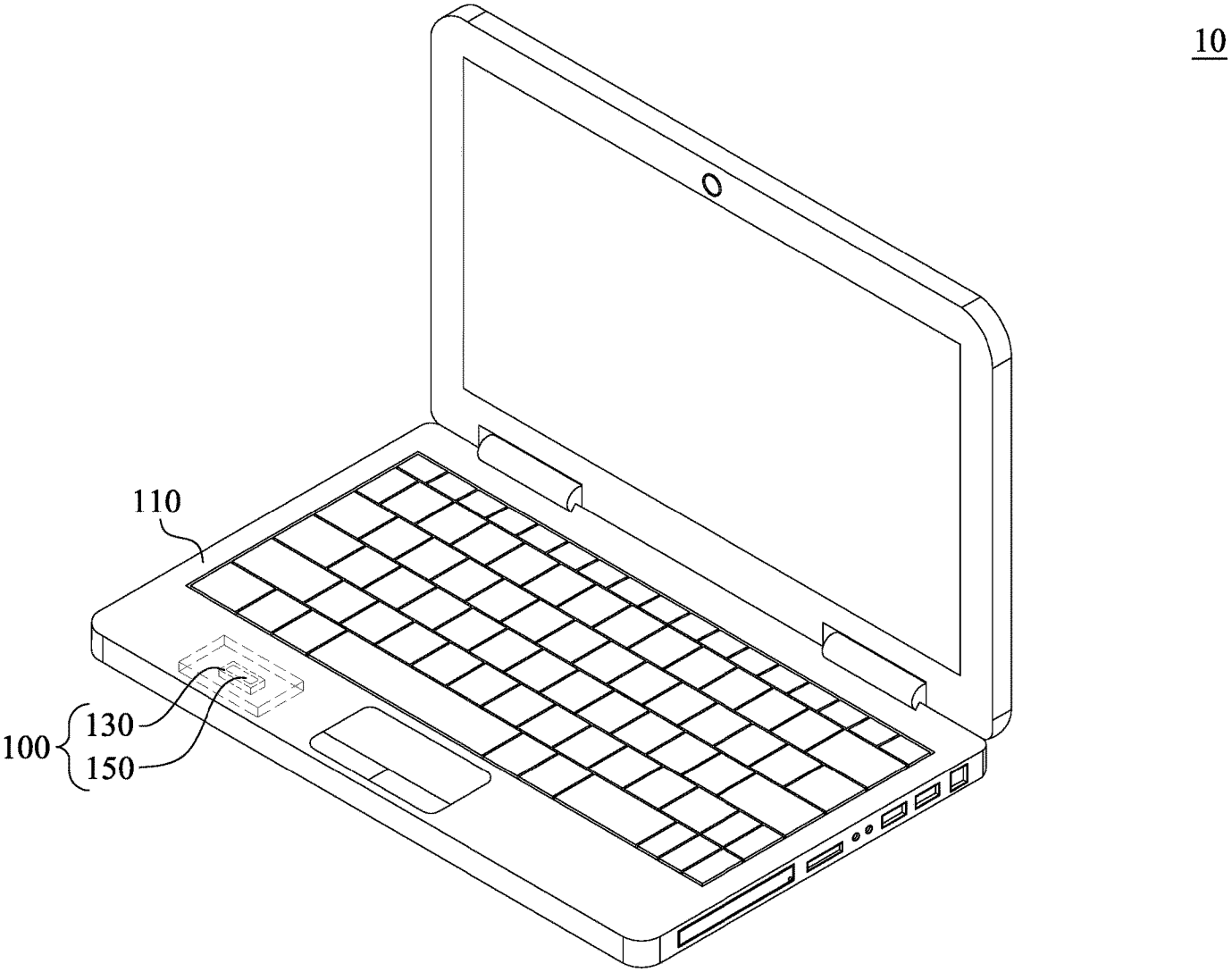
FIG. 1 illustrates a schematic view of an electronic device having a speaker mounted therein in accordance with some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1. FIG. 1 illustrates a schematic view of an electronic device 10 having a speaker 100 mounted therein. The electronic device 10 may be a laptop computer, a tablet computer, or a mobile device (e.g., a mobile phone), and the present disclosure is not limited in this respect. The electronic device 10 has a case 110 forming an accommodating space, and a rubber cabinet 130 and a driver 150 are disposed inside the case 110 for generating various types of sounds.

Figure 2:
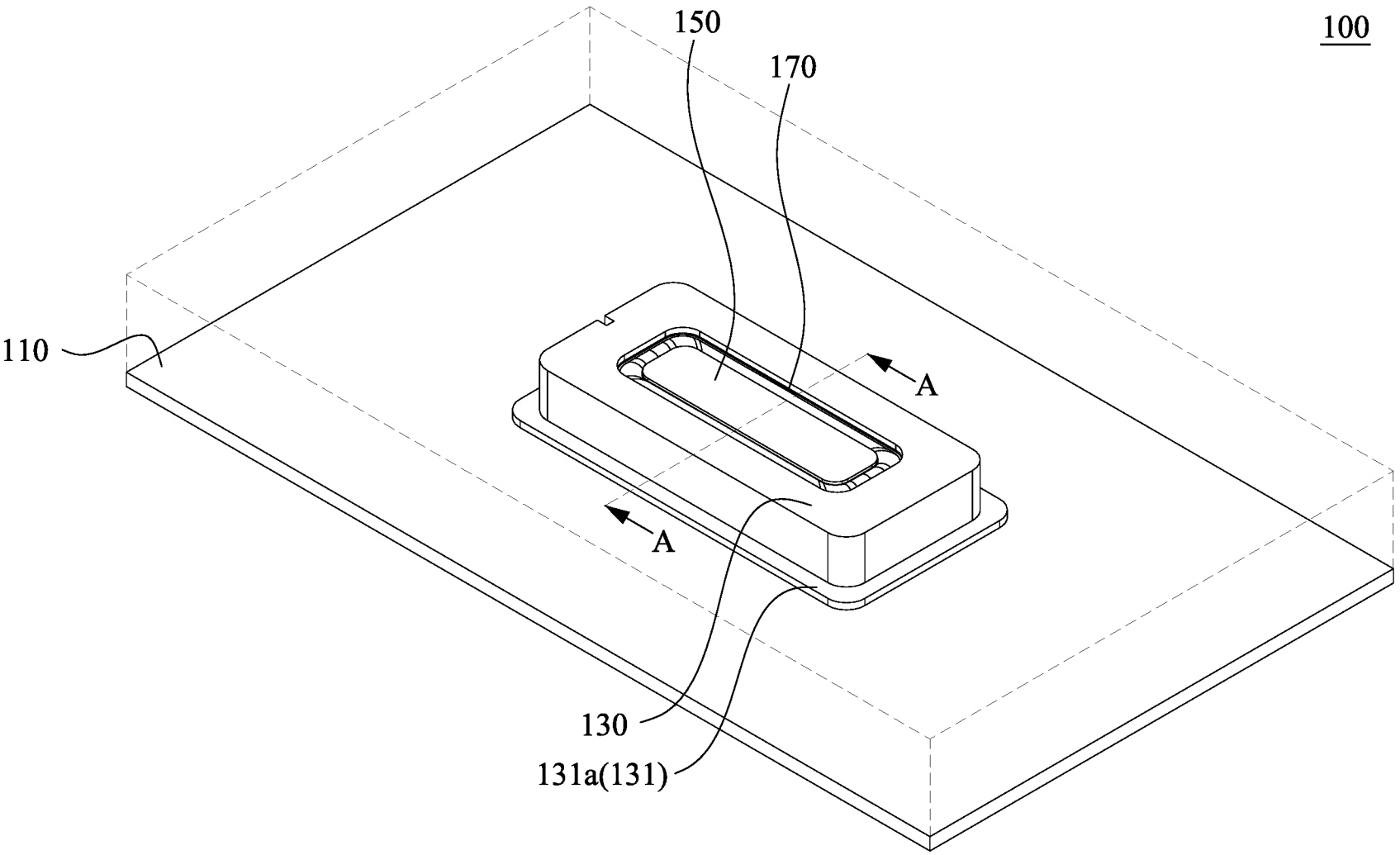
FIG. 2 illustrates a schematic view of the speaker in accordance with some embodiments of the present disclosure.
Figure 3:
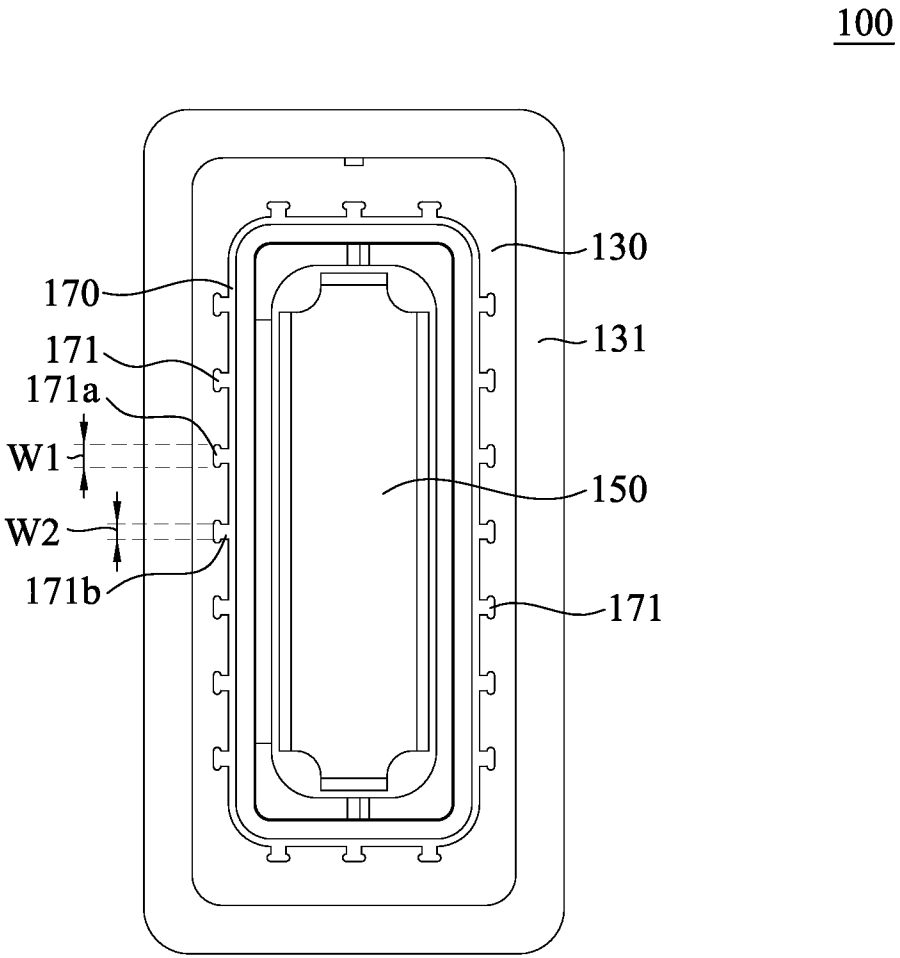
FIG. 3 illustrates a bottom view of a rubber cabinet, a driver, and a metal connection ring in accordance with some embodiments of the present disclosure.
Figure 4:
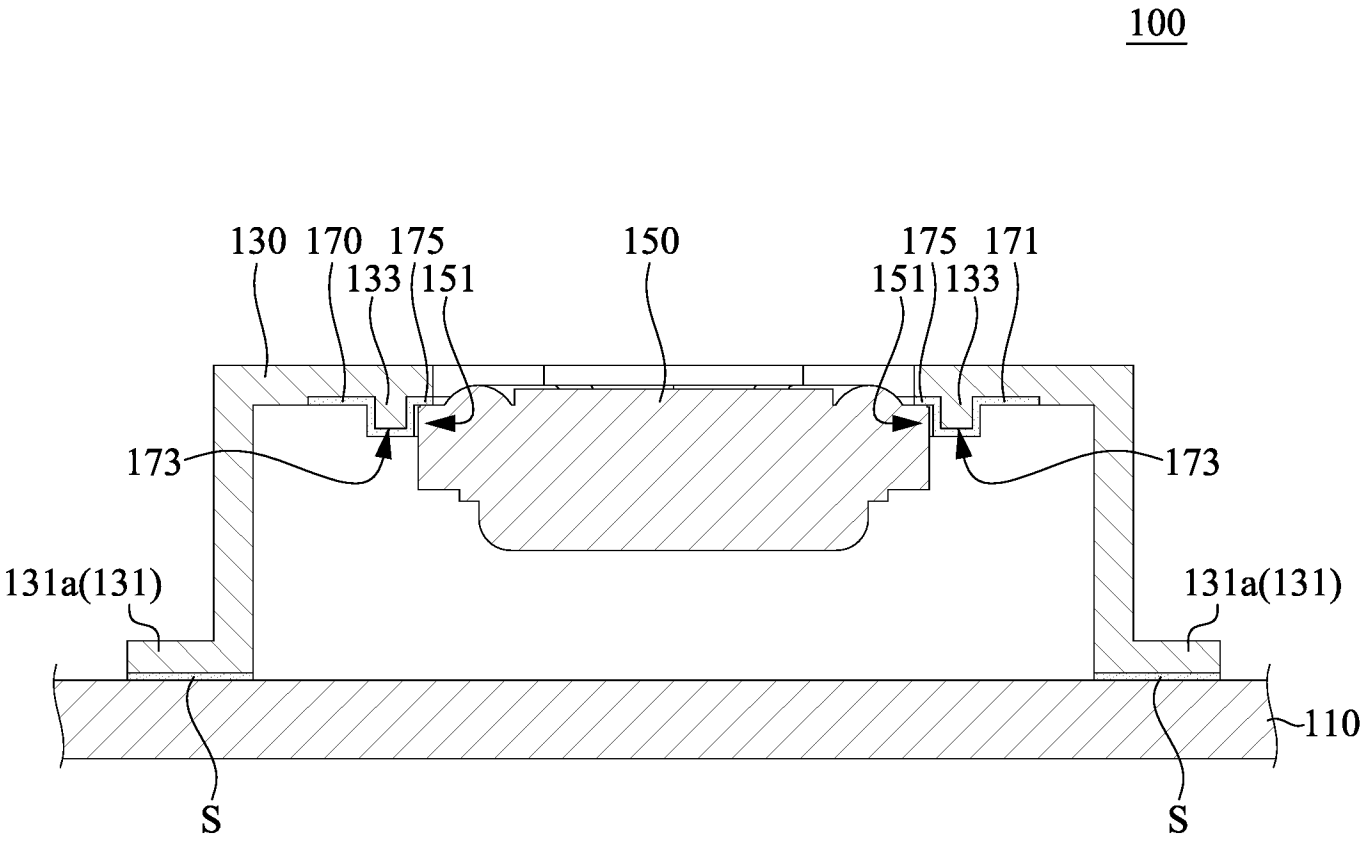
FIG. 4 illustrates a cross-sectional view taken along line A-A in FIG. 2.
Figure 5:
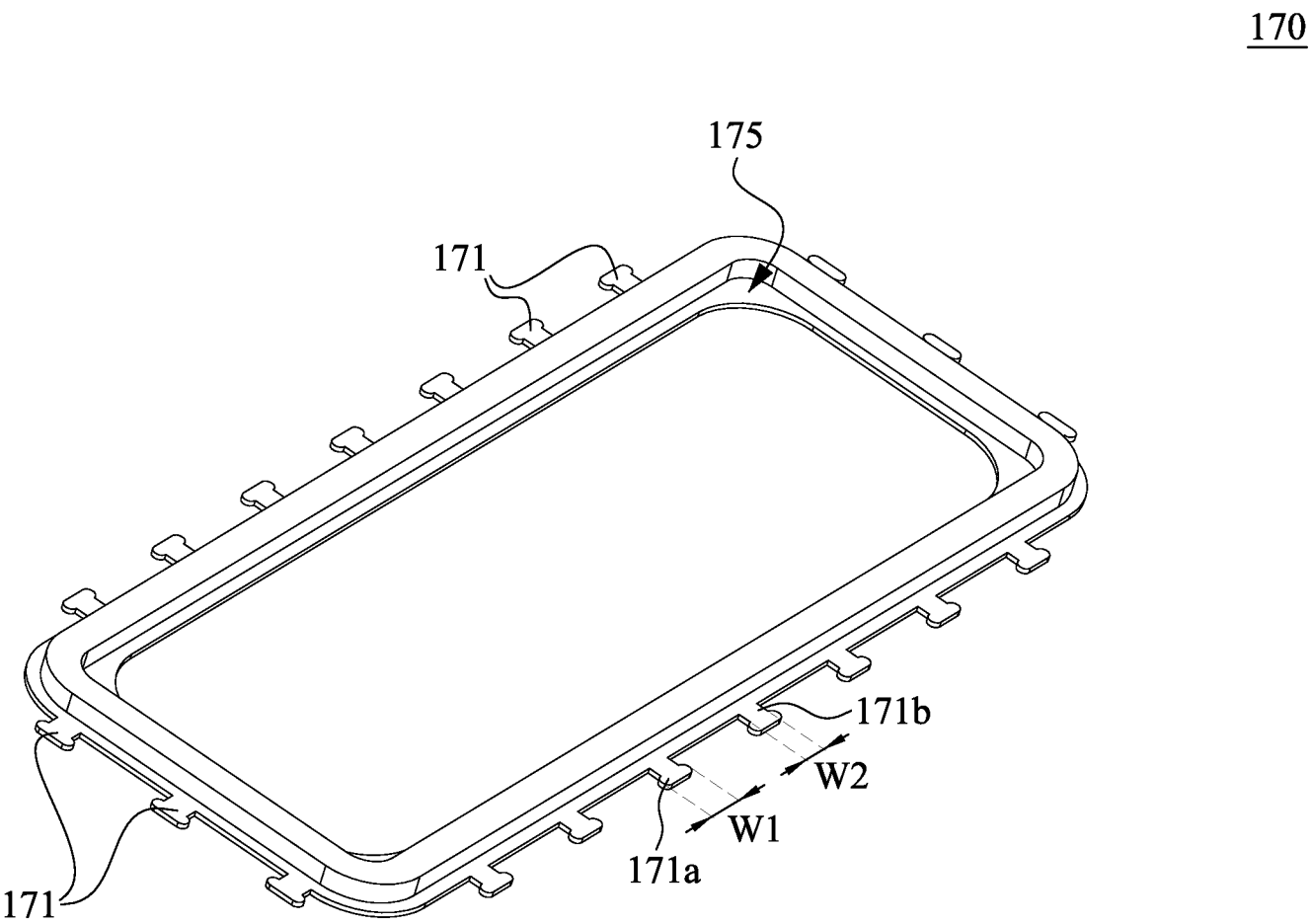
FIG. 5 illustrates a schematic view of a metal connection ring in accordance with some embodiments of the present disclosure.
Figure 6:
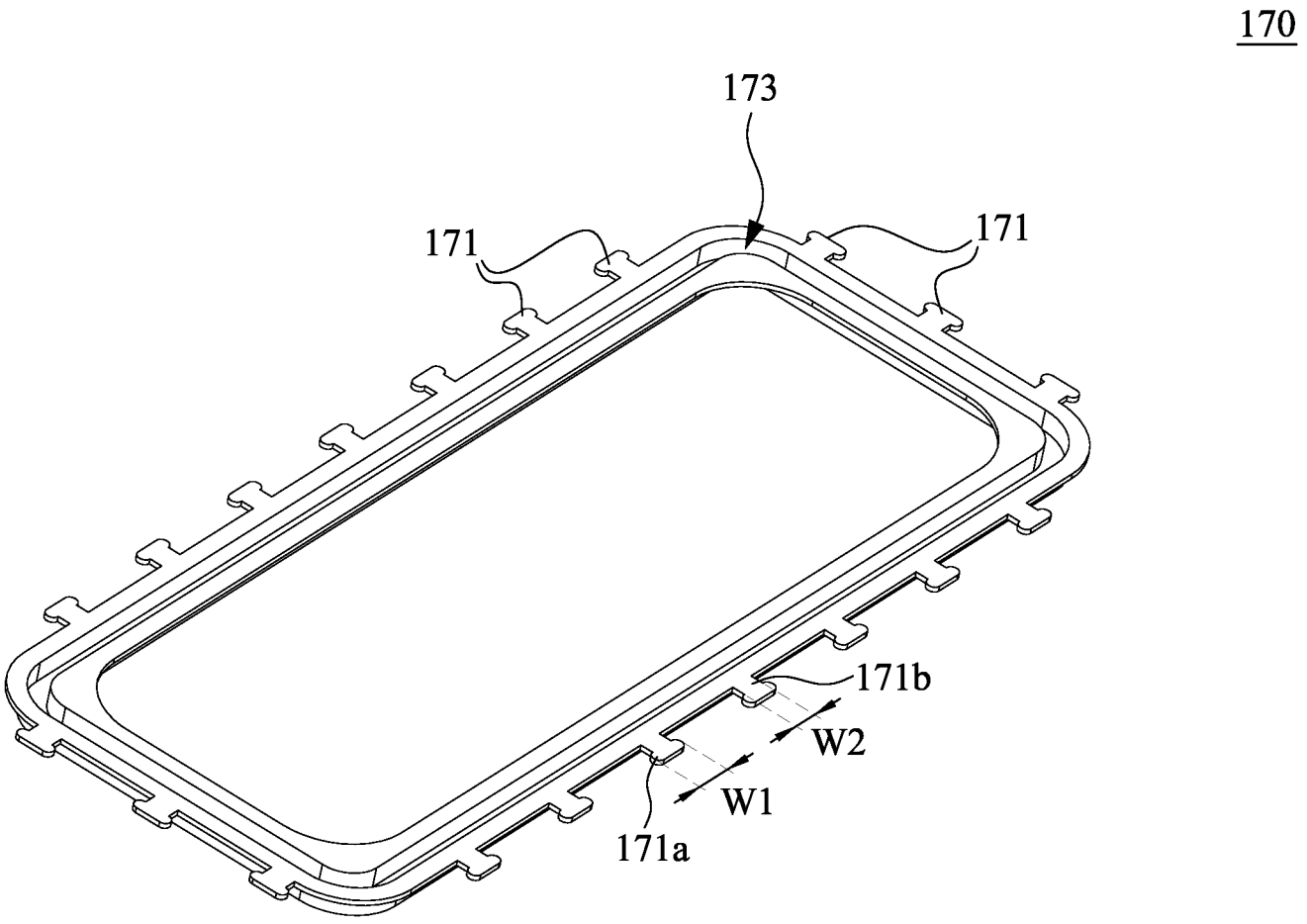
FIG. 6 illustrates another schematic view of the metal connection ring taken from a view different from FIG. 5.

Reference is made to FIGS. 2-6. FIG. 2 illustrates a schematic view of the speaker 100. FIG. 3 illustrates a bottom view of the rubber cabinet 130, the driver 150, and a metal connection ring 170. FIG. 4 illustrates a cross-sectional view taken along line A-A in FIG. 2. FIG. 5 illustrates a schematic view of the metal connection ring 170. FIG. 6 illustrates another schematic view of the metal connection ring 170 taken from a view different from FIG. 5. In one or more embodiments of the present disclosure, the rubber cabinet 130 is fixed to the case 110, and the rubber cabinet 130 accommodates the driver 150. Moreover, the metal connection ring 170 is connected between the rubber cabinet 130 and the driver 150. The metal connection ring 170 surrounds the driver 150, and the rubber cabinet 130 surrounds the metal connection ring 170. The metal connection ring 170 includes a plurality of extension arms 171, and the extension arms 171 are spaced apart along an outer periphery of the metal connection ring 170. Moreover, the extension arms 171 are substantially T-shaped or mushroom-shaped, and thus the metal connection ring 170 can be stably fixed to the rubber cabinet 130 by the extension arms 171. The present disclosure is not limited in this respect. In some embodiments, each extension arm 171 has a first portion 171*a* and a second portion 171*b*, and the first portion 171*a* has a first width W1 greater than a second width W2 of the second portion 171*b*. Moreover, the first portion 171*a* is farther from a center of the metal connection ring 170 than the second portion 171*b*, so the metal connection ring 170 can be stably fixed to the rubber cabinet 130. Since the rubber cabinet 130 is made from rubber, a smaller assembly gap with adjacent elements can be maintained. Moreover, the rubber cabinet 130 can occupy a greater volume under the same accommodating space, and the material of the rubber cabinet 130 can further efficiently absorb sound waves generated by the driver 150, thereby preventing the sound waves from resonating with elements of the speaker 100 and generating noise.

During actual assembly, since it is hard to fix the rubber cabinet 130 to other elements using a general adhesive, spot glue or ultraviolet resin can be used to first fix the driver 150 to the metal connection ring 170. Moreover, an injection molding process can directly form rubber on the metal connection ring 170, and thus the rubber cabinet 130 can be obtained. The rubber cabinet 130 is then fixed to and disposed inside the case 110, such that the speaker 100 can be obtained. The present disclosure is not limited in this respect.

In one or more embodiments of the present disclosure, the rubber cabinet 130 includes a bending bottom 131, and a first portion 131*a* of the bending bottom 131 is fixed to the case 110 and extends outward from the rubber cabinet 130. Moreover, the speaker 100 includes a double-sided adhesive tape S, in which the double-sided adhesive tape S is configured for fixing the bending bottom 131 to the case 110. In practical applications, the double-sided adhesive tape S can stably fix the rubber cabinet 130 to other objects. The double-sided adhesive tape S is directly connected between the case 110 and the rubber cabinet 130. In addition, the double-sided adhesive tape S can be a double-sided acrylic tape or a double-sided silicon tape, and the present disclosure is not limited in this respect.

In one or more embodiments of the present disclosure, the metal connection ring 170 can be made of a metal or alloy, and a stamping process can be performed to the metal or alloy for forming the metal connection ring 170. A standard stamping machine can shape the metal or alloy, and then a cutting process and a bending process can be performed on the shaped metal or alloy for forming the metal connection ring 170 in a desired shape. In addition, the metal connection ring 170 can include a circular ring structure, a triangular ring structure, a square ring structure, or any polygonal ring structure. The "ring" described in the present disclosure can refer to an open surrounding structure or a closed surrounding structure, and the "ring" is not limited any shape. The rubber cabinet 130 includes a ring-shaped protrusion portion 133, and the metal connection ring 170 includes a ring-shaped recess 173. Therefore, the ring-shaped recess 173 can receive the ring-shaped protrusion portion 133. In some embodiments of the present disclosure, the ring-shaped recess 173 has a U-shaped cross section, and the rubber cabinet 130 and the metal connection ring 170 can be stably connected via the ring-shaped recess 173. In addition, the ring-shaped protrusion portion 133 can be a circular ring, a triangular ring, a square ring, or any polygonal ring. The ring-shaped recess 173 can include a circular ring recess, a triangular ring recess, a square ring recess, or any polygonal ring recess. The present disclosure is not limited in this respect.

In one or more embodiments of the present disclosure, the metal connection ring 170 includes a step-shaped interior edge 175, and the step-shaped interior edge 175 is ring-shaped and configured for fixing the driver 150. The step-shaped interior edge 175 can provide contacting surfaces in different directions for fixing the driver 150, and the driver 150 has an edge angle 151 corresponding in shape to the step-shaped interior edge 175. Therefore, the driver 150 is in close contact with the step-shaped interior edge 175 via the edge angle 151, and there is good stability between the metal connection ring 170 and the driver 150. The present disclosure is not limited in this respect.

Figure 7:
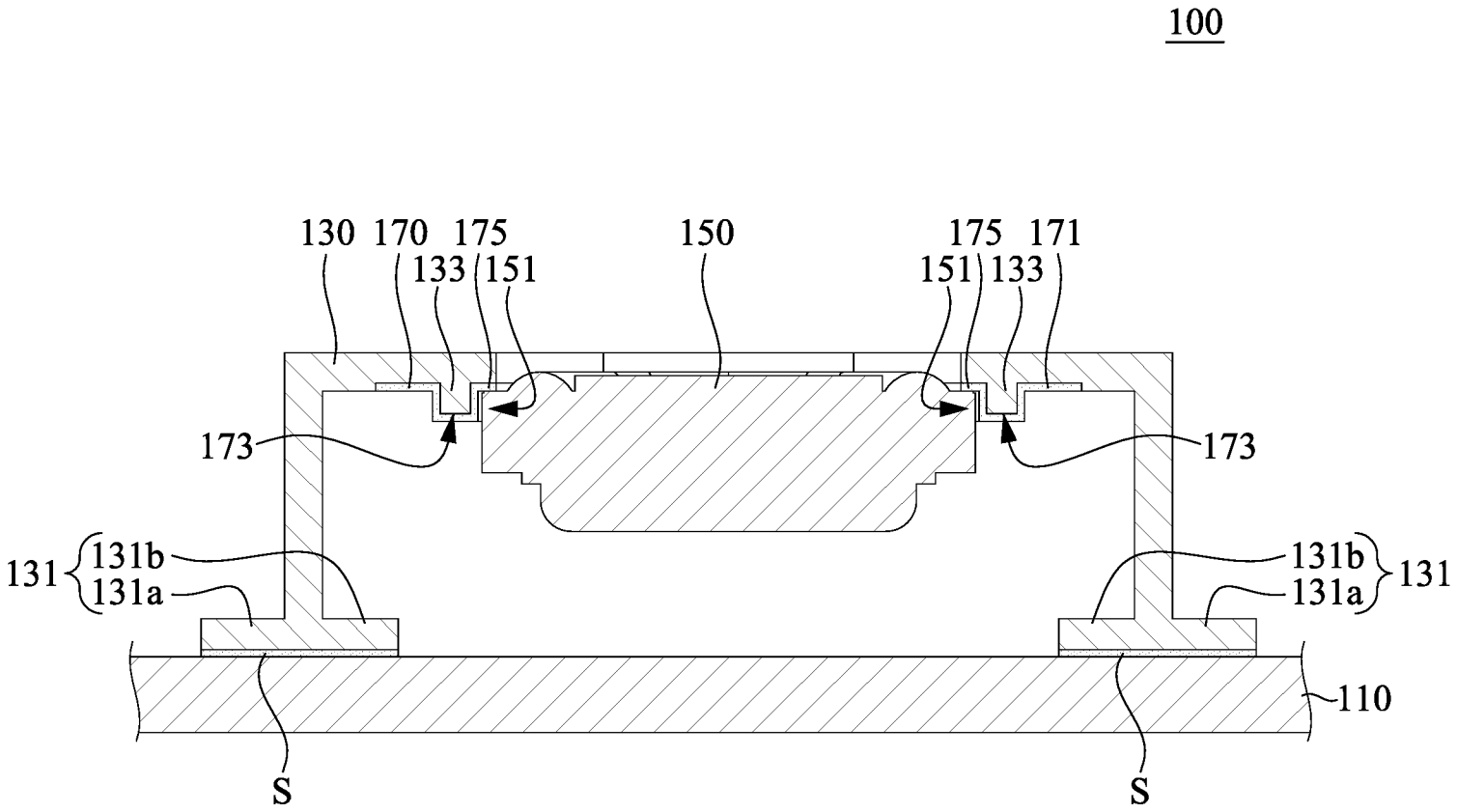
FIG. 7 illustrates another cross-sectional view taken along line A-A in FIG. 2 in accordance with other embodiments of the present disclosure.

FIG. 7 illustrates another cross-sectional view taken along line A-A in FIG. 2 in accordance with other embodiments of the present disclosure. In some embodiments of the present disclosure, the rubber cabinet 130 includes the bending bottom 131, in which a first portion 131*a* of the bending bottom 131 is fixed to the case 110*a* and extends outward from the rubber cabinet 130, and a second portion 131*b* of the bending bottom 131 is fixed to the case 110 and extends inward from the rubber cabinet 130. In short, the bending bottom 131 has the first portion 131*a* and the second portion 131*b* which respectively extend outward and inward from the rubber cabinet 130, and thus the first portion 131*a* and the second portion 131*b* respectively extend in two opposite directions. Therefore, the bending bottom 131 has a significant contacting surface, and the rubber cabinet 130 can be stably fixed to the case 110. The present disclosure is not limited in this respect.

In embodiments of the present disclosure, a speaker with a rubber cabinet is provided, and the rubber cabinet is made of soft material, so as to decrease the needed space thereof. At the same time, the rubber cabinet can occupy a greater space under the same accommodating space, and the rubber cabinet can also absorb sound waves which are generated by a driver of the speaker, thereby preventing the sound waves from resonating with elements of the speaker and producing noise.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A speaker comprising:

a rubber cabinet fixed to a case of an electronic device;

a driver, wherein the rubber cabinet accommodates the driver; and a metal connection ring connected between the rubber cabinet and the driver, wherein the metal connection ring surrounds the driver, and the rubber cabinet surrounds the metal connection ring, wherein the metal connection ring comprises a plurality of extension arms spaced apart along an outer periphery of the metal connection ring.

2. The speaker of claim 1, wherein the extension arms are T-shaped.

3. The speaker of claim 1, wherein each extension arm has a first portion and a second portion, a width of the second portion is smaller than a width of the first portion, and the first portion is farther from a center of the metal connection ring than the second portion.

4. The speaker of claim 1, wherein the rubber cabinet has a bending bottom, and a first portion of the bending bottom is fixed to the case and extends outward from the rubber cabinet.

5. The speaker of claim 4, further comprising a double-sided adhesive tape which fixes the bending bottom to the case.

6. The speaker of claim 1, wherein the rubber cabinet has a bending bottom, and a second portion of the bending bottom is fixed to the case and extends inward from the rubber cabinet.

7. The speaker of claim 6, further comprising a double-sided adhesive tape which fixes the bending bottom to the case.

8. The speaker of claim 1, wherein the rubber cabinet has a bending bottom, a first portion of the bending bottom is fixed to the case and extends outward from the rubber cabinet, and a second portion of the bending bottom is fixed to the case and extends inward from the rubber cabinet.

9. The speaker of claim 8, further comprising a double-sided adhesive tape which fixes the bending bottom to the case.

10. The speaker of claim 1, wherein the rubber cabinet comprises a ring-shaped protrusion portion, and the metal connection ring comprises a ring-shaped recess, wherein the protrusion portion is received in the recess.

11. The speaker of claim 1, wherein the metal connection ring comprises a step-shaped interior edge configured for fixing the driver.

* * * * *